United States Patent [19]

Sharp

[11] 4,032,360

[45] June 28, 1977

[54] METHOD OF REMOVING IRON SULFIDE AND SLUDGE FROM METAL SURFACES

[76] Inventor: Thomas L. Sharp, 715 Nenana St., Houston, Tex. 77035

[22] Filed: Mar. 17, 1976

[21] Appl. No.: 667,626

Related U.S. Application Data

[62] Division of Ser. No. 508,674, Sept. 23, 1974, Pat. No. 4,003,856.

[52] U.S. Cl. ..... 134/3; 134/22 R; 134/41; 252/143

[51] Int. Cl.[2] ..... B08B 3/08

[58] Field of Search ..... 134/22 C, 34, 40, 42, 134/3, 41, 22 R; 252/82, 153, 170, 171, 172, 546, 143, 148, 8.55 B, 162; 166/304, 312

[56] References Cited

UNITED STATES PATENTS

| | | | |
|---|---|---|---|
| 2,356,254 | 8/1944 | Lehmann et al. | 252/170 X |
| 2,700,005 | 1/1955 | Klingel | 134/22 C |
| 3,057,804 | 10/1962 | Berkeley et al. | 252/153 |

*Primary Examiner*—Robert L. Lindsay, Jr.
*Assistant Examiner*—Marc L. Caroff
*Attorney, Agent, or Firm*—Arnold, White & Durkee

[57] ABSTRACT

An oil-soluble composition capable of removing iron sulfide and sludge from metal surfaces and a method of such removal of iron sulfide and sludge from metal surfaces in an oil system, the composition comprising:

a. from about 2 to about 15% by weight of a high molecular weight linear diamine;
b. from about 3 to about 20% by weight of acetic acid;
c. from about 20 to about 50% by weight of a low molecular weight ketone ether solvent;
d. from about 1 to about 15% by weight of an alcohol solvent; and
e. from about 20 to about 50% by weight of a heavy aromatic naphtha solvent.

In the method of removing iron sulfide and sludge from the interior metal surfaces in an oil system, the above composition is added to the effluent of the oil system for onstream treatment in an amount effective to remove the iron sulfide and sludge. Generally, the composition is added to the effluent in an amount of from about 1 to about 20 parts per million of effluent.

2 Claims, No Drawings

METHOD OF REMOVING IRON SULFIDE AND SLUDGE FROM METAL SURFACES

This is a divisional of application Ser. No. 508,674, filed Sept. 23, 1974, now U.S. Pat. No. 4,003,856.

BACKGROUND OF THE INVENTION

1. Field of the Invention

This invention relates to an oil-soluble liquid, capable of removing iron sulfide and sludge from metal surfaces in an oil system, and to a method of removing such iron sulfide and sludge from the interior metal surfaces in an oil system, wherein the composition of the present invention is employed onstream. More particularly, the present invention is directed to such oil-soluble liquid composition and method of removing iron sulfide and sludge therewith, wherein an amine salt formed in situ by reaction of acetic acid and a high molecular weight linear diamine is a principal active ingredient thereof.

2. Summary of the Invention

Due to the difficulties generally encountered in the removal of iron sulfide and sludge from metal surfaces in an oil system, particularly from lean oil and other hydrocarbon heat exchange lines, a composition was developed in accordance with the present invention which effectively allows penetration of a film crust of iron sulfide and sludge. This provides for dispersion of the iron sulfide and sludge in finally divided solid form, allowing easy removal from the oil system. The composition of the present invention, effective for the removal of iron sulfide and sludge from the metal surfaces in an oil system, comprises:

a. from about 2 to about 15% by weight of a high molecular weight linear diamine;
b. from about 3 to about 20% by weight of acetic acid;
c. from about 20 to about 50% by weight of a low molecular weight ketone ether solvent;
d. from about 1 to about 15% by weight of an alcohol solvent; and
e. from about 20 to about 50% by weight of a heavy aromatic naphtha solvent.

The method of the present invention is carried out to remove iron sulfide and sludge from the interior metal surfaces in an oil system by adding to the effluent of the oil system for onstream treatment an effective iron sulfide and sludge removing amount of the above composition. Generally, such composition is employed in accordance with the present invention in an amount of about 1 to about 20 parts per million of effluent.

Accordingly, it is a principal feature of the present invention to provide an oil-soluble composition capable of removing iron sulfide and sludge from metal surfaces in an oil system, wherein such composition effectively disperses iron sulfide and sludge in finally divided solid form, thereby allowing effective removal of the same;

It is a further feature of the present invention to provide such an oil-soluble composition capable of removing iron sulfide and sludge from metal surfaces in an oil system, specifically from lean oil and other hydrocarbon heat exchange lines, wherein such composition includes as a principal component thereof an amine salt formed in situ from a high molecular weight diamine and acetic acid;

It is yet a further feature of the present invention to provide such oil-soluble composition capable of removing iron sulfide and sludge from metal surfaces in an oil system, wherein the composition comprises a high molecular weight diamine, acetic acid, a low molecular weight ketone ether solvent, an alcohol solvent and a heavy aromatic naphtha solvent;

It is still a further feature of the present invention to provide a method or removing iron sulfide and sludge from the interior metal surfaces in an oil system, particularly from lean oil and other hydrocarbon heat exchange lines, which method comprises adding to the effluent of the oil system for onstream treatment an effective iron sulfide and sludge removing amount of the composition of the present invention;

Yet a further feature of the present invention involves such method of removing iron sulfide and sludge from the interior metal surfaces in an oil system, wherein the composition of the present invention is employed in an amount of from about 1 to about 20 parts per million of effluent;

Still further features and advantages of the present invention will become apparent from the following more detailed description thereof.

DESCRIPTION OF THE PREFERRED EMBODIMENTS

The foregoing features of the present invention and the advantages associated therewith are associated with an oil-soluble composition which is effective in the removal of iron sulfide and sludge from metal surfaces in an oil system. Preferably, the composition of the present invention is utilized in the removal of iron sulfide and sludge from the interior metal surfaces from lean oil and other hydrocarbon heat exchange lines in which the accumulation of iron sulfide and sludge presents a serious problem to heat transfer through the conducting pipes. The composition of the present invention and the method of utilizing the same allow the effective removal of the iron sulfide and sludge through a combination of components which provides for penetration of the film crust on the interior metal surfaces and dispersion of the iron sulfide and sludge as finally divided solids. The composition of the present invention can be utilized in very small quantities to disperse large amounts of iron sulfide and sludge and provides only slight discoloration of the effluent utilized. Where desired, a filter or other similar means can be utilized to extract a high content of the dispersed iron sulfide and/or sludge.

The composition of the present invention has as a principal active component an amine salt formed in situ by the reaction of two of the composition's components, a high molecular weight diamine and acetic acid. This amine salt, which is formed in situ, has a polar attraction for the iron present in the iron sulfide and sludge and, presumably due to this polar attraction, effectively dislodges the iron ions from the sludge, attaching to the metal surfaces in the form of a corrosion-inhibiting barrier.

The remaining components of the compositions of the present invention act as solvents in the oil-soluble composition, providing for the necessary penetration of the composition through the sludge. Each of the three solvent materials acts as a penetrant and a dissolving agent for hydrocarbons, with each being necessary to achieve the high degree of penetration and dispersion achieved in accordance with the composition and method of the present invention. The first of the solvents employed is a low molecular weight ketone ether solvent. The second is an alcohol solvent. The third, a heavy aromatic naphtha solvent.

The composition of the present invention generally has a pH within the range of 3.5 to 5, the pH generally being around pH 4. Moreover, when carrying out the method of the present invention, the composition of the present invention can be added directly to the effluent stream of an oil system to provide onstream treatment effective for the removal of iron sulfide and sludge. Alternatively, prior to introduction, the composition of the present invention can be mixed with the effluent in any desired proportion. The composition of the present invention is employed in an amount effective to provide the desired removal of the iron sulfide and sludge, with an amount of about 1 to about 20 parts of the composition of the present invention per million parts of effluent being generally employed. It should be apparent, however, that depending upon the nature of the sludge, and depending upon the amount of the iron sulfide and sludge deposit, the composition of the present invention can be employed in slightly greater or lesser amounts than described above.

The onstream ability of the composition of the present invention to effectively remove iron sulfide and sludge is an advantage of the composition and method of the present invention over previously developed systems. Accordingly, when utilizing the composition and method of the present invention, it is unnecessary to shut down the system and the simple introduction of the composition of the present invention into the effluent stream in an amount effective to remove the iron sulfide and sludge is all that is required. This provides for great economic savings. It should be understood that the composition of the present invention may be injected at a convenient point upstream of the surface to be treated. Once injected in the oil stream, the composition then passes through the vessel or vessels (e.g., heat exchanger) containing interior surfaces in need of treatment for removal of iron sulfide and sludge.

The composition of the present invention will now be described by reference to the individual components, including preferred embodiments thereof, with specific reference being made to the weight percentage of each component in the composition of the present invention. It should be understood that more than one of each of the following components can be effectively utilized.

High Molecular Weight Linear Diamine

The diamine employed in the composition of the present invention is a high molecular weight linear diamine, preferably a diamine having a carbon chain derived from a higher fatty acid. In accordance with the preferred embodiment of the present invention, such diamine contains from 12 to 30 carbon atoms, with exemplary diamines useful in accordance with the present invention including, for example, tallow diamine having an amine value of 325 to 340, or coco diamine having an amine value of about 400. Of course, any and all diamines falling within the above description of carbon chain length can be applicably utilized in accordance with the present invention.

The diamine is employed in an amount of from about 2 to about 15% by weight, preferably 3 to 8% by weight. In the most preferred embodiment of the present invention, the diamine is employed in an amount of 4 to 6% by weight. Of course, slight deviations from the foregoing amounts can be tolerated, and the use of slightly greater or lesser amounts is still within the spirit and scope of the present invention.

Acetic Acid

Any industrial or commercial form of acetic acid can be advantageously utilized in the composition and method of the present invention. The acetic acid is generally employed in an amount of from about 3 to about 20% by weight, preferably 5 to 10% by weight. In the most preferred embodiment of the present invention, the acetic acid is employed in an amount of 6 to 8% by weight. Here again, as was the case with respect to the diamine, slight deviations from these amounts are within the scope of the present invention.

As previously indicated, it is presumed that the amine and acetic acid react in situ to form a salt, i.e., amine diacetate. This is the principal active component of the composition of the present invention, which component is responsible for the dislodgement and dispersion of the iron ions from the sludge, and the dispersion of the sludge and iron sulfide in the oil system.

Low Molecular Weight Ketone Ether Solvent

The low molecular weight ketone ether solvent is employed as one of the solvent components of the composition. These materials are conventional solvents having both a ketone moiety and an ether or lower alkoxy group. Generally, the low molecular weight ketone ether solvent is one which has from 4 to 8 carbon atoms, with a preferred material being 4-methoxy-4-methyl-2-pentanone, having the impirical formula $C_7H_{14}O_2$. Also applicable in accordance with the present invention are the corresponding butanone ($C_4H_8O_2$), ($C_6H_{12}O_2$) and octanone ($C_8H_{16}O_2$).

The ketone ether solvent is generally employed in an amount of from about 20 to about 50% by weight, preferably 30 to 40%, based upon the weight of the composition. In the most preferred embodiment of the present invention, the ketone ether solvent is employed in an amount of 34 to 36% by weight. Here again, slightly greater or lesser amounts than the above can be employed to achieve the advantages of the present invention.

Alcohol Solvent

The second solvent employed in the composition of the present invention is an alcohol solvent. This material can be any conventional solvent material having an alcoholic function. Preferably, the alcoholic solvent is a material selected from lower aliphatic solvents and diacetone alcohol. Diacetone alcohol is preferred due to the higher flash point this alcohol solvent contributes to the composition, as compared, for example, with the lower aliphatic alcohols. The lower aliphatic alcohols are generally those having up to 6 carbon atoms with isopropyl alcohol being preferred. Of the alcohol solvents applicable in accordance with the present invention, the best results with respect to penetration of the iron sulfide and sludge for dispersion of the same and removal of the same is achieved utilizing diacetone alcohol.

The alcohol solvent is generally employed in an amount of from about 1 to about 15% by weight, preferably 5 to 10% by weight based upon the weight of the composition. In the most preferred embodiment of the present invention, the alcohol solvent is employed in an amount of 8 to 10% by weight. Again, as was the case with regard to the previously discussed components, slightly lesser or greater amounts of the alcohol solvent can be utilized in the composition of the present invention.

Heavy Aromatic Naphtha Solvent

The heavy aromatic naphtha is the third and final solvent employed in the composition of the present invention. These solvent materials, also known as heavy naphtha or crude heavy solvent naphtha are aromatic solvents derived from coal tar by fractional distillation, generally being a mixture of xylene and higher homologs. Generally, the heavy naphthas or crude heavy solvent naphthas have a specific gravity of 0.885 to 0.90 and a boiling point within the range of 160°–220° C. Any and all of the naphthas falling within the above description can be applicably employed in accordance with the present invention. A preferred naphtha is a commercially available aromatic material having a KB value of 112.

The heavy aromatic naphtha solvent is employed in accordance with the composition of the present invention in an amount of from about 20 to 50% by weight, preferably 40 to 50% by weight based on the weight of the composition. In the most preferred embodiment of the present invention, the heavy aromatic naphtha solvent is employed in an amount of 44 to 48% by weight. Again, slightly lesser or greater amounts can be employed, while still achieving the advantages of the present invention.

The three solvents employed in the composition of the present invention, when utilized individually, do not provide adequate penetration and dispersion of the iron sulfide and sludge. However, when such solvents are used in combination, the composition of the present invention effectively penetrates and disperses the iron sulfide and sludge, thereby allowing easy removal of the same.

The method of the present invention is effectively carried out by adding the composition described above to the effluent of the oil system, particularly in lean oil or other hydrocarbon heat exchange lines. A particular advantage of this method is that treatment for the removal of iron sulfide and sludge can be carried out onstream, and it is unnecessary to shut down operations for this cleaning. The composition can be added directly to the effluent onstream, or can first be diluted with additional effluent prior to addition. In either event, the composition is employed in an amount effective to remove the iron sulfide and sludge present in the system. Generally, it is employed in an amount of from about 1 to about 20 parts of composition per million parts of effluent.

The present invention will now be described by reference to the following examples. It must be understood that these examples are presented solely for purposes of illustration, and the present invention cannot, under any circumstances, be deemed limited thereby.

EXAMPLE 1

In this example, the following composition was utilized: 5% tallow diamine, 7.3% acetic acid, 34% 4-methoxy-4-methyl-2-pentanone, 8.7% diacetone alcohol, and 45% aromatic naphtha KB = 112.

The above composition was employed to clean a gas-producing plant wherein the temperature differential at the lean oil chiller was 10° F. The lean oil system was a 250 gallon per minute system. One gallon of the above composition was utilized per day for 10 days. As a result of such use, the iron sulfide and sludge deposits were removed, and the temperature differential dropped to 2° F. The operating still end point went from 425 to 490. This illustrates the effectiveness of the above composition in removing iron sulfide and sludge.

EXAMPLE 2

The same composition as used in Example 1 was employed in a 500 gallon per minute system of a natural gas plant. The temperature differential in the heat exchanger was 42° F., indicating coating with iron sulfide and sludge. Three gallons of the composition were utilized for three days, and the temperature differential dropped to 12° F. Only slight discoloration of the lean oil resulted. Again, the effectiveness of the above composition in removing iron sulfide and sludge is shown.

While the present invention has been described primarily with respect to the foregoing exemplification of preferred materials and amounts, the present invention cannot in any way be limited thereto, but, rather, must be construed as broadly as any and all equivalents thereof.

What is claimed is:

1. A method of removing iron sulfide and sludge from interior surfaces in an oil system which comprises adding to the effluent of the oil system for onstream treatment an effective iron sulfide and sludge removing amount of a composition comprising:

a. from about two to about fifteen percent by weight of a high molecular weight linear diamine derived from a higher fatty acid containing from 12 to 30 carbon atoms;

b. from about three to about twenty percent by weight of acetic acid;

c. from about 20 to about 50 percent by weight of a low molecular weight ketone ether solvent containing from four to eight carbon atoms;

d. from about 1 to about 15 percent by weight of an alcohol solvent selected from aliphatic alcohols containing up to six carbon atoms and diacetone alcohol; and e. from about 20 to about 50 percent by weight of a heavy aromatic naphtha solvent having a specific gravity of 0.885 to 0.970 and a boiling point within the range of 160°–220° C.

2. The method of claim 1, wherein said composition is employed in an amount of about 1 to about 20 parts per million of effluent.

* * * * *